US007520940B2

(12) United States Patent
Yoon et al.

(10) Patent No.: US 7,520,940 B2
(45) Date of Patent: Apr. 21, 2009

(54) STEAM OXIDATION OF POWDER METAL PARTS

(75) Inventors: Hyung Kyu Yoon, Peoria, IL (US); Thomas E. Clements, Peoria, IL (US); Daniel Patrick Vertenten, Aurora, IL (US); David Anthony Cusac, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 264 days.

(21) Appl. No.: 10/901,366

(22) Filed: Jul. 29, 2004

(65) Prior Publication Data

US 2006/0024516 A1 Feb. 2, 2006

(51) Int. Cl.
*C23C 26/00* (2006.01)

(52) U.S. Cl. ..... 148/284; 148/537; 419/19; 419/54; 419/55

(58) Field of Classification Search ..... 148/284, 148/537; 419/19, 54, 55
See application file for complete search history.

(56) References Cited

U.S. PATENT DOCUMENTS 3,751,005 A * 8/1973 Earley ..... 251/368
4,141,759 A 2/1979 Pfistermeister
4,153,480 A * 5/1979 Coester et al. ..... 148/286
4,297,150 A 10/1981 Foster et al.
4,501,613 A * 2/1985 Matsumoto ..... 75/240
4,602,690 A * 7/1986 Steiger ..... 175/325.6
5,413,642 A 5/1995 Alger
5,561,834 A * 10/1996 Score ..... 419/19
5,741,372 A * 4/1998 Gugel ..... 148/276
6,106,429 A 8/2000 Mortensen
6,531,517 B1 3/2003 Wachter et al.

FOREIGN PATENT DOCUMENTS

EP 0229325 7/1987
EP 0640958 10/1989
JP 56-169705 * 12/1981

OTHER PUBLICATIONS

"Steam Treating," ASM Handbook, vol. 7, Powder Metal Technologies and Applications, Heat Treatment of Ferrous Powder Metallurgy Parts, 2002.

* cited by examiner

*Primary Examiner*—Jennifer McNeil
*Assistant Examiner*—Jason Savage
(74) *Attorney, Agent, or Firm*—Finnegan, Henderson, Farabow, Garrett & Dunner

(57) ABSTRACT

A method of forming an oxide layer on a powder metal part includes subjecting the powder metal part to a steam oxidation process. An oxide layer is formed on the powder metal part. The oxide layer has a thickness greater than 7 microns.

21 Claims, 5 Drawing Sheets

STEAM OXIDATION OF POWDER METAL PARTS

TECHNICAL FIELD

The present disclosure is directed to powder metallurgy and, more particularly, to a process for forming a protective layer on powder metal parts.

BACKGROUND

For many applications, powder metallurgy may provide a desirable alternative to conventionally manufactured ferrous and non-ferrous parts. The powder metallurgical process involves mixing elemental or alloy powders, compacting the mixture in a die, and sintering the resulting parts to metallurgically bond the powder metal particles. Thus, various parts, including those with complex profiles, may be fabricated without the costs associated with machining processes.

As the applications for powder metal parts grows, however, powder metal parts are increasingly being employed in tribologically stressed environments (e.g., environments that may include friction, wear, scuffing, or other types of physical stress). Powder metal parts, however, possess relatively low wear and scuffing resistance, which can result in premature failures, particularly in many sliding applications.

Powder metallurgy may be used to make components such as, for example, thrust buttons and thrust washers, which may experience tribologically stressed environments. These components may provide bearing surfaces in a variety of applications including rotary and sliding applications, and impinging force applications, and any other suitable applications. Thrust washers and thrust buttons can be included in the drive train of a machine to minimize or prevent wear due to scuffing and frictional sliding of various components of a drive train system (e.g., planet carriers, planet pads, sun gears, internal gears, side gears, drive shafts, etc.). Because of the relatively low wear and scuffing resistance of powder metal thrust buttons and thrust washers, these components may require frequent replacement. Thus, there is a need to increase the wear and scuffing resistance of powder metal parts to extend the service life of components including powder metal thrust washers and thrust buttons, among others.

At least one process for improving the wear resistance of powder metal parts has been proposed. For example, as described in *ASM Handbook: Powder Metal Technologies and Applications* (*vol* 7), powder metal parts may be subjected to a steam oxidation process for improving wear resistance of those parts. According to the described process, the powder metal components are heated in a steam atmosphere at temperatures between 510° C. and 570° C. to form an oxide surface layer. This layer may be significantly harder than the powder metal base material and may serve to fill any surface porosity of the component. As noted in the *ASM Handbook*, however, adhesion of the surface layer to the underlying powder metal base material is strongly influenced by the process time and temperature used in the steam oxidation technique. At process temperatures above 570° C., spalling or flaking of the surface oxide layer can occur. Further, the *ASM Handbook* indicates that, to avoid flaking of the surface layer due to surface tensile stress, the maximum thickness of the surface oxide layer should not exceed 7 microns.

While the described steam oxidation process disclosed in the ASM Handbook may increase the wear and scuffing resistance of certain powder metal parts, the surface oxide layer formed by the described process may be inadequate for many applications. For example, many parts, such as thrust buttons and thrust washers, for example, may be exposed to environments where the wear resistance and scuffing resistance provided by a surface oxide layer of less than 7 microns may be insufficient. As a result, the steam oxidation process described in the *ASM Handbook* may not extend the service life of certain powder metal parts by an appreciable amount.

The present disclosure is directed to overcoming one or more of the problems of the prior art steam oxidation technique.

SUMMARY OF THE INVENTION

One aspect of the present disclosure includes a method of forming an oxide layer on a powder metal part. The method may include subjecting the powder metal part to a steam oxidation process and forming an oxide layer on the powder metal part. The oxide layer has a thickness greater than 7 microns.

Another aspect of the present disclosure includes a powder metal component having at least one wear surface. An oxide layer may be disposed on the at least one wear surface of the powder metal component. The oxide layer has a thickness of greater than 7 microns.

DETAILED DESCRIPTION

Figure 1:
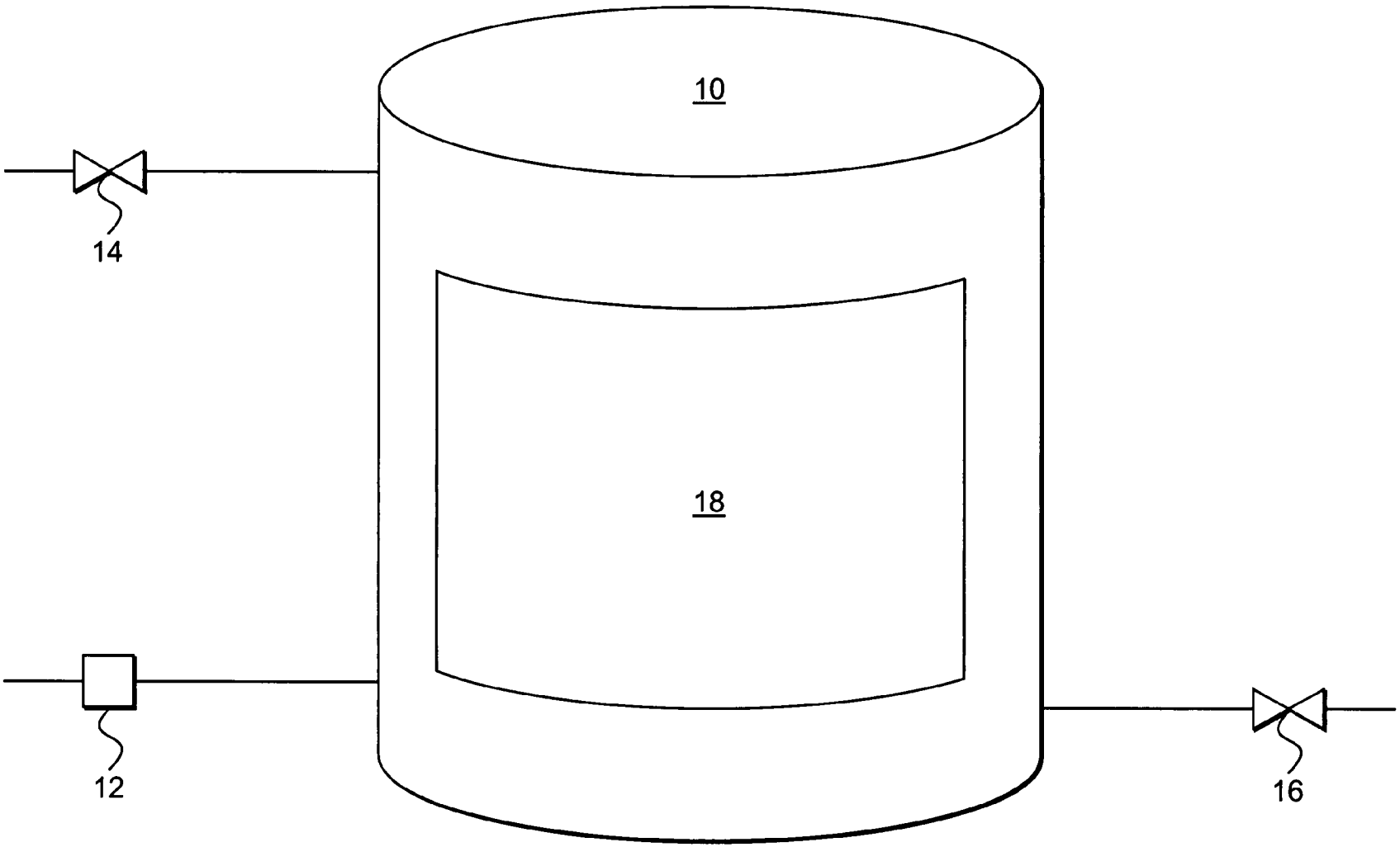
FIG. 1 is a schematic illustration of an exemplary furnace apparatus used for steam oxidation of powder metal parts according to the present method.

FIG. 1 provides a schematic representation of a furnace 10 for performing the disclosed steam oxidation treatment of powder metal parts. Furnace 10 may include a temperature controller 12, a steam supply valve 14 connected to a source of steam (not shown), an exhaust valve 16, a furnace chamber 18, and one or more heating elements (not shown).

In an exemplary disclosed embodiment, a power metal component may be placed in furnace chamber 18, and temperature controller 12 may be used to create a desired time-temperature profile within furnace chamber 18.

Temperature controller 12 may be manually controlled or may be automated such that a computer or other controller can adjust temperature controller 12 to match a predetermined or programmed time-temperature profile in furnace chamber 18.

Steam supply valve 14 may be adjusted to control an amount of steam admitted to furnace chamber 18. During the disclosed steam oxidation process, steam supply valve 14 may be placed in a fully open position, a fully closed position, or at any partially open position. Further, like temperature controller 12, steam supply valve 14 may be adjusted either manually or automatically (e.g., using a controller and one or more actuators) to provide a desired steam versus time profile in furnace chamber 18.

Similarly, exhaust valve 16 may be adjusted to further control the amount of steam in furnace chamber 18. For example, in a closed position, exhaust valve 16 minimizes or, ideally, prevents the flow of steam out of furnace chamber 18. In a partially to fully open state, exhaust valve 16 may be used to control the flow rate of steam through furnace chamber 18. In one embodiment, exhaust valve 16 may be manually or automatically adjusted separately or in tandem with steam supply valve 14 to provide the desired steam flow rate through furnace chamber 18. In this manner the steam flow rate may be regulated anywhere between zero flow and a maximum flow rate. In certain applications, the steam flow rate may be controlled to vary according to a predetermined time-flow rate profile.

The disclosed steam oxidation process may be used with any suitable powder metal component. Metals that may be used to make powder metal components may include, for example, aluminum, antimony, beryllium, bismuth, brass, bronze, carbon steel, chromium, cobalt, copper, copper alloy, copper infiltrated steel, copper steel, copper infiltrated iron, gold, iron, iron steel, iron-copper-steel, iron-nickel-steel, low alloy steel, magnesium, manganese, molybdenum, nickel, nickel silver, nickel steel, palladium, platinum, silver, sinter hardened steel, stainless steel, steel, tantalum, tin, titanium, tungsten, tungsten carbide, and any suitable alloys of these materials.

In the case of ferrous powder metal parts, steam oxidation according to the disclosed process may form a layer of iron oxide according to the following chemical reaction:

$$3Fe+4H_2O\ (steam) \rightarrow Fe_3O4_4+H_2\ (gas).$$

Thus, through this reaction, the oxide layer formed on a ferrous powder metal part may include iron oxide ($Fe_3O_4$).

The disclosed steam oxidation process may include heating a powder metal part in a predetermined manner and exposing a powder metal component to steam. The component may be exposed to the steam at predetermined times while the component is heated and for predetermined periods of time.

In one disclosed embodiment, the steam oxidation process may include placing one or more powder metal parts into furnace chamber 18 of furnace 10. The temperature in furnace chamber 18 may be raised to a first temperature and maintained for a first predetermined amount of time. The first temperature may be within a range of about 350° C. to about 390° C. In one exemplary embodiment, the first temperature may be about 360° C. The first predetermined amount of time may be between about 1 to 2 hours. In one exemplary embodiment, the first predetermined amount of time may be about 1.5 hours.

Next, steam may be introduced into furnace chamber 18 using steam supply valve 14. A flow of steam can be maintained by opening exhaust valve 16 and allowing steam to flow into the chamber through steam supply valve 14. The amount of steam admitted to furnace chamber 18 may be sufficient to maintain a positive pressure in furnace chamber 18.

Once the steam has been introduced, the temperature in furnace chamber 18 may be raised to a second temperature and maintained for a second predetermined period of time. The second temperature may be within a range of about 460° C. to about 500° C. In one exemplary embodiment, the second temperature may be about 482° C. The second predetermined period of time may be between about 10 to 30 minutes. In one exemplary embodiment, the second predetermined amount of time may be about 20 minutes.

Next, exhaust valve 16 may be closed to maintain a steam environment in furnace chamber 18, but without a continuously flowing supply of steam (e.g., steam supply valve 14 may remain open while exhaust valve 16 is closed). The steam may be held in furnace chamber 18 for a third predetermined period of time. The third predetermined period of time may be between about 15 to 45 minutes. In one exemplary embodiment, the third predetermined amount of time may be about 30 minutes.

The temperature in furnace chamber 18 may then be raised to a third temperature and maintained for a fourth predetermined period of time. The third temperature may be within a range of about 570° C. to about 610° C. In one exemplary embodiment, the third temperature may be about 593° C. The fourth predetermined period of time may be between about 30 minutes to 1 hour. In one exemplary embodiment, the fourth predetermined amount of time may be about 45 minutes.

Then, the temperature in furnace chamber 18 may be reduced to a fourth temperature, steam supply valve 14 may be closed, and exhaust valve 16 may be opened to allow excess steam to escape. Finally, the powder metal parts may be quenched in oil. The fourth temperature may be within a range of about 350° C. to about 390° C. In one exemplary embodiment, the fourth temperature may be about 371° C.

This disclosed steam oxidation process may form an oxide layer on the surface of the powder metal part. In one embodiment, the oxide layer may have a thickness of more than 7 microns. In another embodiment, the oxide layer may have a thickness of between about 8 microns and about 11 microns. In still another embodiment, the oxide layer may have a thickness of between about 9 microns and about 10 microns.

Figure 2:
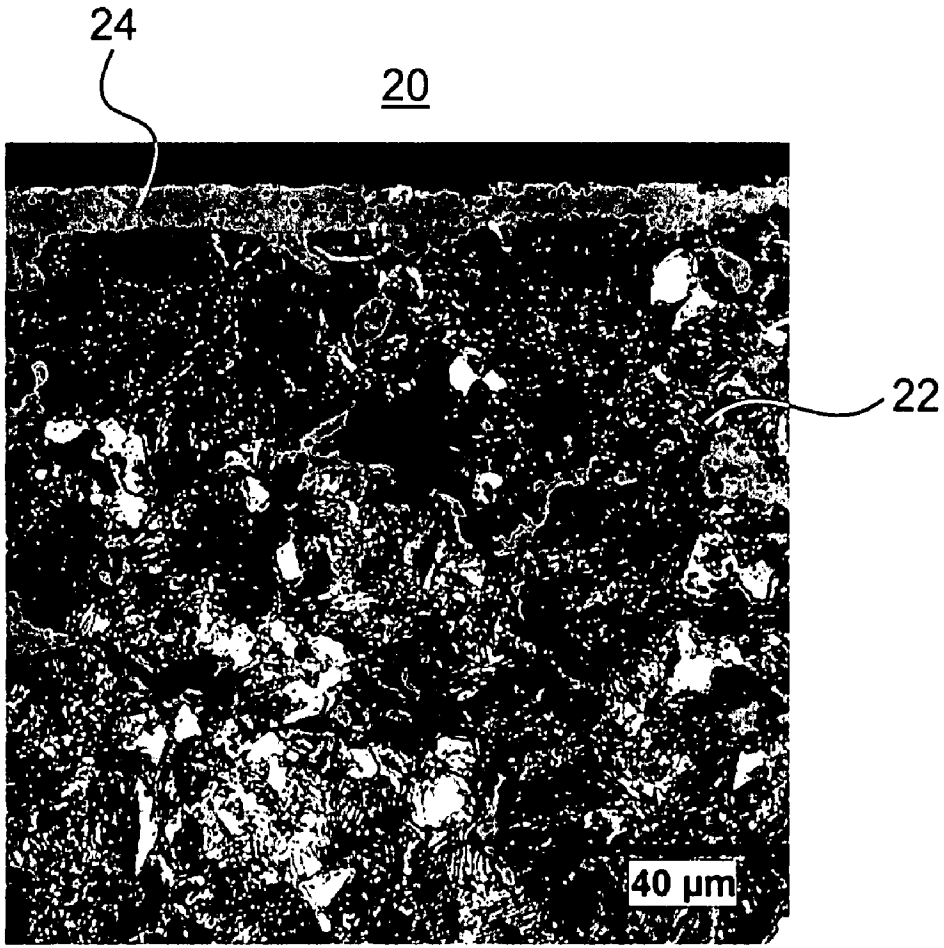
FIG. 2 is a pictorial representation of a cross-sectional optical micrograph of a powder metal component having a protective oxide layer formed by an exemplary steam oxidation method.

FIG. 2 is a pictorial representation of a cross-sectional optical micrograph of a powder metal sample 20 formed by the disclosed steam oxidation method. The micrograph of FIG. 2 was obtained using an Olympus AX-70 optical microscope. As shown, sample 20 includes a powder metal base material 22 and a protective oxide layer 24 formed on base material 22. Oxide layer 24 provides substantially uniform coverage of a surface of base material 22. The thickness of oxide layer 24 is greater than 7 microns, and an average thickness of oxide layer 24 is between about 8 microns and about 11 microns. A significant portion of oxide layer 24, as shown in FIG. 2, has an average thickness of approximately 9 microns.

INDUSTRIAL APPLICABILITY

The disclosed steam oxidation process may improve the tribological performance of powder metal components. For example, the oxide layer formed on the surface of these components may be more resistant to wear and scuffing than the underlying powder metal material. Thus, the powder metal parts and processes of the present disclosure may be used in any application where powder metal parts having enhanced wear and scuffing resistance may be desired. Some exemplary applications for the disclosed steam oxidation processes and protective layers may include thrust washers, thrust buttons, thrust bearings, sleeve bearings, fuel pump rotors, sprockets, gears, cams, rollers, pinions, pistons, shaft plates, valve guides, valve seats, valve gears, valve plates, rotors, roller retainers, worm wheels, shift cams, slide sleeves, starter gears, flanges, cylinders, connecting rods, magnetic actuators, mechanical diodes, spur gears, and any other appropriate components.

The physical properties of an oxide layer formed on a powder metal part through steam oxidation may depend on the processing conditions and steps used to form the layer. For example, in contrast to the steam oxidation processes of the prior art, the disclosed steam oxidation process enables production of oxide layers thicker than those of conventional processes. These thicker oxide layers may provide added protection against wear and other physical stresses experienced by a powder metal component. Further, the thicker oxide layers (e.g., greater than 7 microns), made possible by the disclosed steam oxidation process, do not tend to flake from the powder metal base material like the oxide layers formed by conventional processes.

Figure 3:
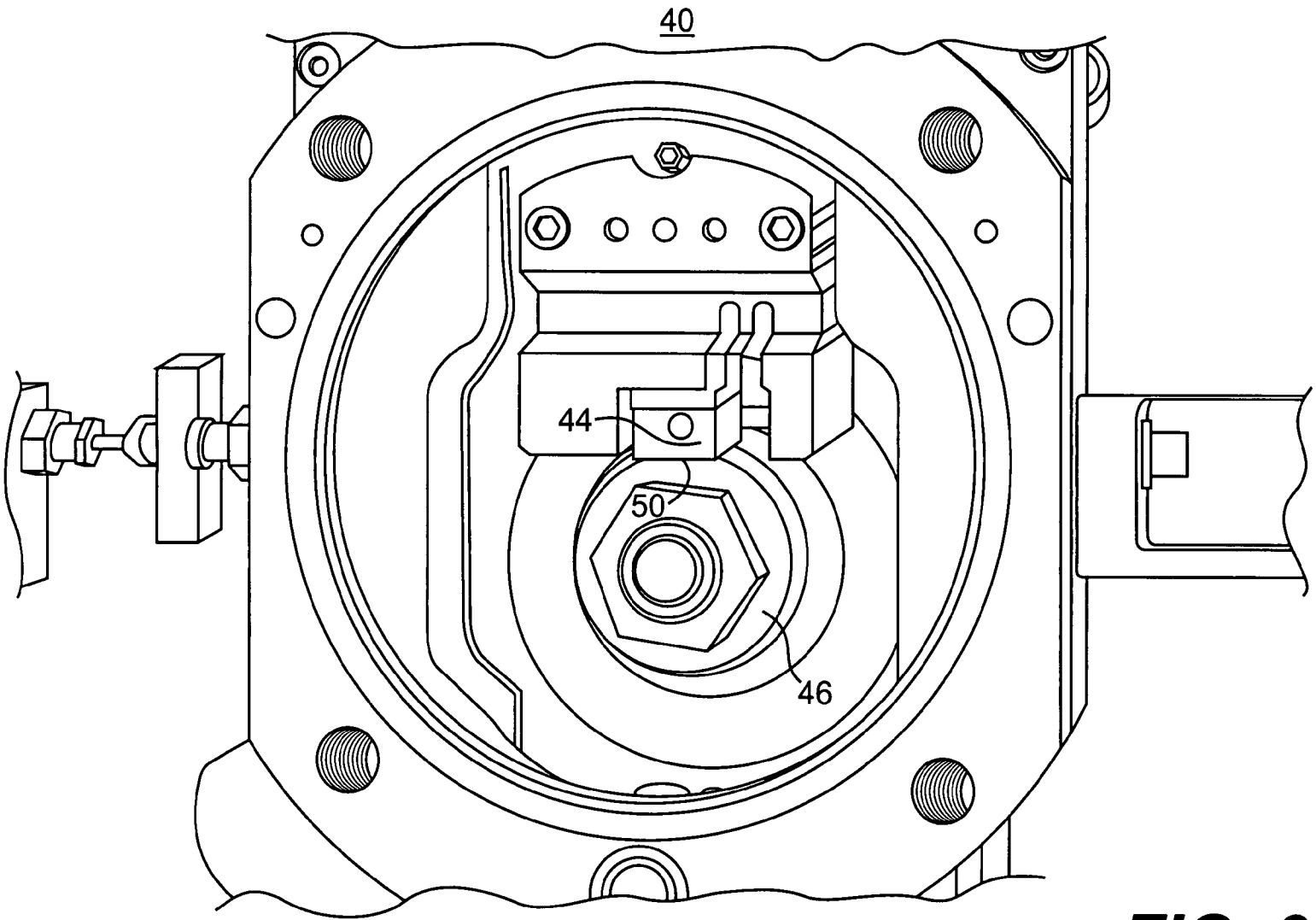
FIG. 3 is a schematic illustration of an exemplary apparatus used for collecting scuffing performance data.

Powder metal components having a protective oxide layer formed according to the disclosed steam oxidation process have exhibited significant resistance to scuffing. FIG. 3 provides a schematic illustration of a block-on-ring testing device 40 used for measuring scuffing resistance. Scuffing is a condition that may result when two surfaces mate in sliding contact and under load. Heat generated by friction between the surfaces can cause localized melting and/or welding to occur. As a result, material from one surface may be transferred to the other surface and vice-versa, and the mating surfaces may become rougher. The added roughness causes more friction, which generates even more heat and further compounds scuffing.

Block-on-ring testing device 40 may include a stationary sample block 44, which includes a sample of the material to be measured. Sample block 44 is contacted with a rotating ring 46. By pressing rotating ring 46 against sample block 44 with a known force and monitoring the resistance of the sliding interface 50 between rotating ring 46 and block 44, the frictional coefficient of sample block 44 can be determined. At predetermined time intervals, the load placed on rotating ring 46 may be incrementally increased, and the effect on the coefficient of friction can be observed. The onset of scuffing may appear as an abrupt rise in the observed coefficient of friction of sample block 44.

Figure 4:
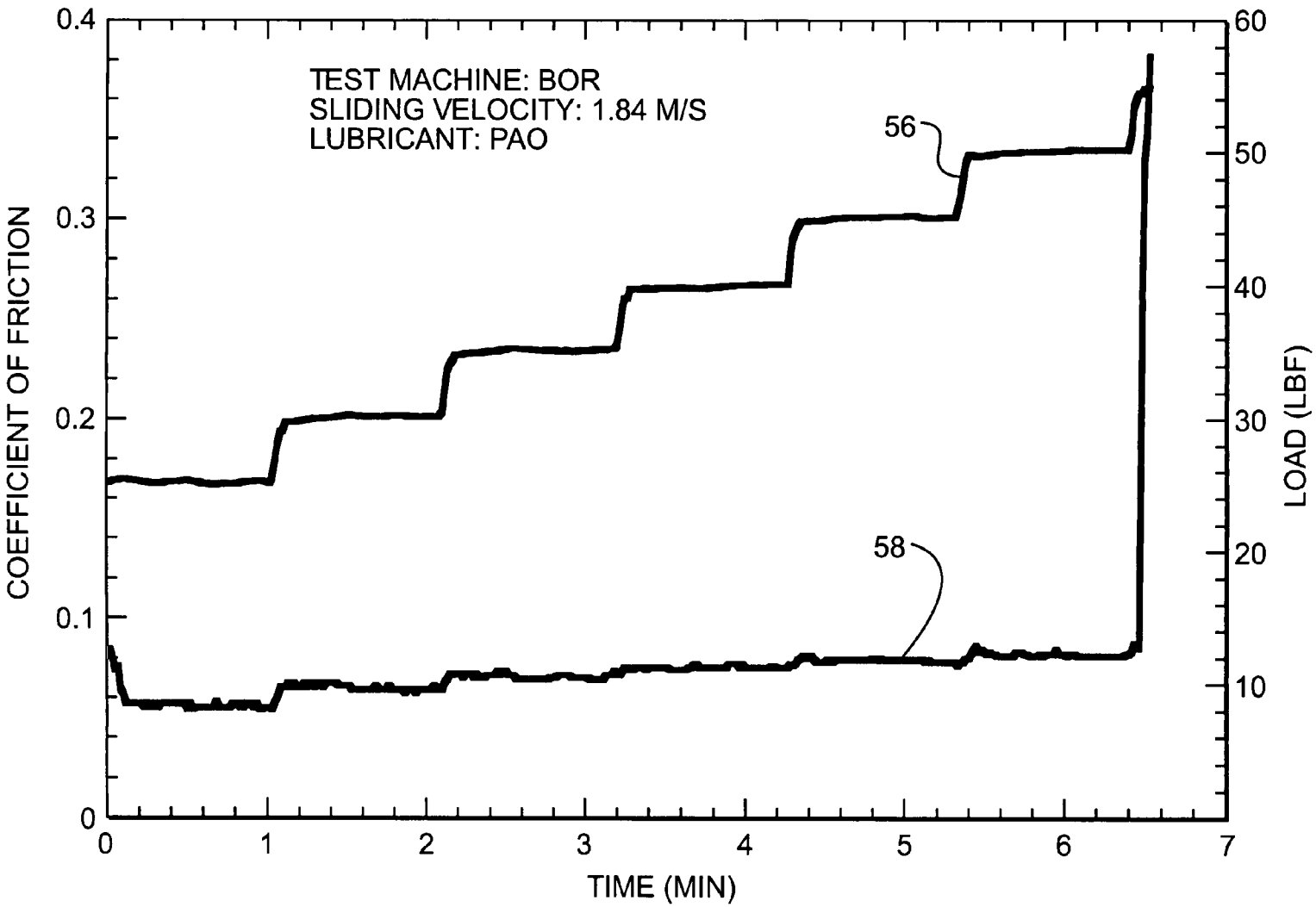
FIG. 4 is a graph of scuffing data for a powder metal component with no protective oxide layer.

FIG. 4 is a graph of scuffing data obtained for a powder metal component with no protective oxide layer. Curve 56 represents the load applied to rotating ring 46 as a function of time. Specifically, the load was progressively increased by 5 lbf at approximately one-minute intervals until scuffing failure occurred. The test was performed at a sliding velocity of 1.84 m/s. A summary of the testing conditions appears in the Table below.

Testing Conditions

| Testing conditions | |
|---|---|
| Loading Condition | Step loading (initial load: 25 lbf and 5 lbf step) |
| Test Duration | 1 minute/each step |
| Sliding Speed | 1000 RPM (1.84 m/s) |
| Contact Condition | Initial line contact with 100% sliding |
| Type of Motion | Unidirectional |
| Test Temperature | Room temperature |
| Lubrication Condition | Submerged lubrication |

Curve 58, in FIG. 4, represents the frictional coefficient data collected for a powder metal component having no oxide layer formed by steam oxidation. As shown by curve 58, the coefficient of friction for the uncoated sample ranged from about 0.06 to about 0.08 until the applied load was increased to 55 lbf. Under that load, curve 58 shows a sharp increase in the coefficient of friction of the uncoated powder metal sample. Thus, for the powder metal sample having no protective oxide layer, scuffing failure occurred at a time of approximately 6.5 minutes and under a load of about 55 lbf.

Figure 5:
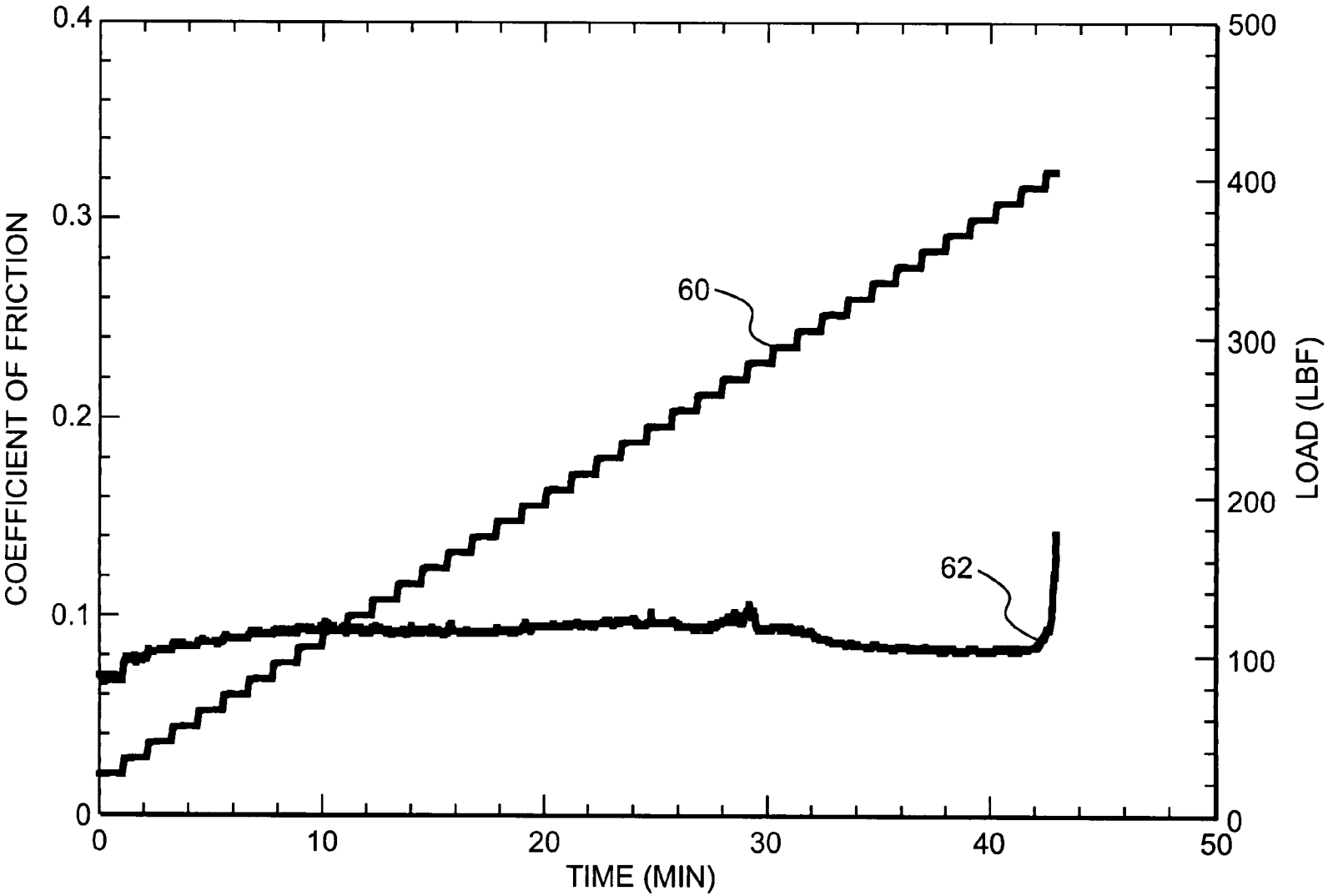
FIG. 5 is a graph of scuffing data for a powder metal component having a protective oxide layer formed by an exemplary steam oxidation method.

FIG. 5 is a graph of scuffing data obtained for a powder metal component-having a protective oxide layer formed by an exemplary disclosed steam oxidation method. Curve 60 represents the load applied to rotating ring 46 as a function of time. Specifically, the load was progressively increased by 10 lbf at approximately one-minute intervals until scuffing failure occurred. The test was performed at a sliding velocity of 1.84 m/s. Curve 62 represents the frictional coefficient data collected for the oxide-coated powder metal component. As shown by curve 62, the coefficient of friction for the sample ranged from about 0.07 to about 0.1 until the applied load was increased to about 400 lbf. Under that load, curve 62 shows a sharp increase in the coefficient of friction of the coated powder metal sample. Thus, for the powder metal sample having a protective oxide coating formed by the disclosed steam oxidation process, scuffing failure occurred at a time of approximately 43 minutes and under a load of about 400 lbf, which is nearly an eight-fold increase with respect to the scuffing performance of the uncoated sample, as represented by curve 58 in FIG. 4.

It will be apparent to those skilled in the art that various modifications and variations can be made in the steam oxidation methods and oxide layers without departing from the scope of the disclosure. Additionally, other embodiments of the steam oxidation methods and oxide layers will be apparent to those skilled in the art from consideration of the specification. It is intended that the specification and examples be considered as exemplary only, with a true scope of the disclosure being indicated by the following claims and their equivalents.

The invention claimed is:

1. A method of forming an oxide layer on a powder metal part, comprising:

placing the powder metal part in a furnace;

raising a temperature of the furnace to a first temperature;

maintaining the furnace at the first temperature for a first predetermined amount of time;

maintaining the powder metal part in a steam environment for a period of time greater than or equal to about 15 minutes;

maintaining the furnace at a second temperature between about 460° C. and about 500° C. for a period of time greater than or equal to about 10 minutes, the second temperature being higher than the first temperature;

maintaining the furnace at a third temperature between about 570° C. and about 610° C. for a period of time greater than or equal to about 30 minutes; and forming an oxide layer on the powder metal part, wherein the oxide layer has a thickness greater than about 7 microns.

2. The method of claim 1, wherein the thickness of the oxide layer is between about 8 microns and about 11 microns.

3. The method of claim 1, wherein the thickness of the oxide layer is between about 9 microns and about 10 microns.

4. The method of claim 1, wherein the powder metal part is one of a thrust button and a thrust washer.

5. The method of claim 1, wherein the first temperature is between about 350° C. and about 390° C.

6. The method of claim 5, wherein the first predetermined period of time is between 1 to 2 hours.

7. The method of claim 1, wherein maintaining the furnace at a second temperature includes maintaining the furnace at the second temperature for a period of time between about 10 minutes and about 30 minutes.

8. The method of claim 1, wherein maintaining the powder metal part in a steam environment includes exposing the powder metal part to steam in a substantially non-flowing state, for a period of time between about 15 minutes and about 45 minutes.

9. The method of claim 1, wherein maintaining the furnace at a third temperature includes maintaining the furnace at the third temperature for a period of time between about 30 minutes to about 1 hour.

10. The method of claim 1, further including reducing the temperature in the furnace to a fourth temperature and quenching the powder metal part.

11. The method of claim 10, wherein the quenching occurs in oil.

12. The method of claim 10, wherein the fourth temperature is between about 350° C. to about 390° C.

13. A method of forming an oxide layer on a powder metal part, comprising:

placing the powder metal part in a furnace;

maintaining the furnace at a first temperature between about 350° C. and 390° C. for a first time period between about 1 to about 2 hours;

subjecting the powder metal part to an atmosphere of steam for a predetermined amount of time;

maintaining the furnace at a second temperature between about 460° C. and about 500° C. for a second time period;

maintaining the furnace at a third temperature between about 570° C. and about 610° C. for a third time period; and quenching the powder metal part to form the oxide layer, wherein a thickness of the oxide layer is greater than about 7 microns.

14. The method of claim 13 wherein, the second time period is between about 10 minutes and about 30 minutes, and the third time period is between about 30 minutes to about an hour.

15. The method of claim 13, wherein subjecting the powder metal part to an atmosphere of steam includes exposing the part to a substantially non-flowing steam environment for a period of time between about 15 minutes to about 45 minutes.

16. The method of claim 13, wherein quenching the powder metal part includes cooling the furnace to a temperature between about 350° C. to about 390° C. before quenching the part.

17. A method of forming an oxide layer on a powder metal part, comprising:

placing the powder metal part in a furnace;

heating the furnace to a first temperature for a period of time greater than or equal to about one hour;

soaking the part in steam for a period of time greater than or equal to about 15 minutes;

maintaining the furnace at a second temperature for a period of time greater than or equal to about 10 minutes, the second temperature higher than the first temperature;

maintaining the furnace at a third temperature between about 570° C. to about 610° C. for a period of time between about 30 minutes to about 1 hour, the third temperature being higher than the second temperature; and cooling the furnace to form the oxide layer on the part, wherein the oxide layer is greater than about 7 microns.

18. The method of claim 17, wherein cooling the furnace further includes cooling the furnace to a temperature between about 350° C. to about 390° C., then quenching the part in oil.

19. The method of claim 17, wherein preheating the furnace to a first temperature includes maintaining the furnace at a temperature between about 350° C. to about 390° C. for a period of time between about 1 hour to about 2 hours.

20. The method of claim 17, wherein maintaining the furnace at a second temperature includes maintaining the furnace at a temperature between about 460° C. to about 500° C. for a period of time between about 10 minutes to about 30 minutes.

21. The method of claim 17, wherein soaking the part in steam includes maintaining the part in a substantially non-flowing steam environment for a period of time between about 15 minutes to about 45 minutes.

* * * * *